US011280533B2

(12) United States Patent
Choi

(10) Patent No.: US 11,280,533 B2
(45) Date of Patent: Mar. 22, 2022

(54) REFRIGERATOR AND METHOD OF CONTROLLING THE SAME

(71) Applicant: LG ELECTRONICS INC., Seoul (KR)

(72) Inventor: Byoungsuk Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 208 days.

(21) Appl. No.: 16/452,218

(22) Filed: Jun. 25, 2019

(65) Prior Publication Data

US 2020/0003473 A1 Jan. 2, 2020

(30) Foreign Application Priority Data

Jun. 28, 2018 (KR) ..... 10-2018-0074495

(51) Int. Cl.
*F25C 5/182* (2018.01)
*F25C 5/02* (2006.01)

(52) U.S. Cl.
CPC ..... *F25C 5/182* (2013.01); *F25C 5/02* (2013.01); *F25C 2400/10* (2013.01); *F25C 2600/02* (2013.01); *F25C 2600/04* (2013.01)

(58) Field of Classification Search
CPC ..... F25C 5/182; F25C 5/02; F25C 2400/10; F25C 2600/02; F25C 2600/04; F25C 5/22; F25C 2700/00; F25C 1/00; F25D 29/00; F25D 2700/02
USPC ..... 62/459
See application file for complete search history.

(56) References Cited

U.S. PATENT DOCUMENTS

2009/0235674 A1* 9/2009 Kern ..... F25C 5/20 62/71
2010/0122547 A1 5/2010 Han et al.
2010/0292846 A1 11/2010 Lee et al.
2014/0165600 A1* 6/2014 Boarman ..... F25C 5/06 62/3.3
2016/0216022 A1 7/2016 Park et al.

FOREIGN PATENT DOCUMENTS

JP 2007-051857 3/2007
KR 10-2008-0003675 1/2008
KR 10-0900287 5/2009
KR 10-2010-0054678 5/2010
KR 10-2010-0124068 11/2010
KR 10-2018-0009505 1/2018

OTHER PUBLICATIONS

Korean Notice of Allowance dated Apr. 23, 2020 issued in KR Application No. 10-2018-0074495.
European Search Report dated Nov. 5, 2019 issued in EP Application No. 19182459.8.
Korean Office Action dated Dec. 13, 2019 issued in KR Application No. 10-2018-0074495.

* cited by examiner

*Primary Examiner* — Steve S Tanenbaum
(74) *Attorney, Agent, or Firm* — KED & Associates LLP

(57) ABSTRACT

A method of controlling a refrigerator includes detecting opening/closing of an ice dispensing duct, through which ice is taken out, and storing an opening time of the ice dispensing duct per time interval. Each time interval is classified as a use time when the opening time of the ice dispensing duct is equal to or greater than a reference time and each time interval is classified as a non-use time when the opening time of the ice dispensing duct is less than the reference time.

15 Claims, 10 Drawing Sheets

FIG. 9

FIG. 10

| U | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| ~ | ... ... | | | | | | | | | | | | | | | | | | | | | | | |
| R2 | 0 | 0 | 0 | 0 | 0 | 0 | 11 | 13 | 10 | 9 | 8 | 5 | 5 | 0 | 0 | 0 | 0 | 10 | 12 | 5 | 5 | 0 | 0 | 3 |
| R1 | 10 | 0 | 0 | 0 | 10 | 12 | 15 | 12 | 10 | 5 | 13 | 12 | 0 | 0 | 0 | 0 | 10 | 12 | 15 | 11 | 9 | 0 | 0 | 3 |

(a)

| U | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| D1 | UT | | | | | | UT | UT | UT | | | | UT | | | | | | | UT | UT | | | UT |
| D2-D6 | ... ... | | | | | | | | | | | | | | | | | | | | | | | |
| D7 | UT | | | | | UT | UT | UT | | | | UT | UT | UT | | | | UT | | UT | UT | UT | | UT |

(b)

| U | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| D1 | P | P | L | L | | H | H | | L | L | | | P | P | P | L | L | | H | | L | | H | L |
| D2-D6 | | | | | | | | | | | | | | | | | | | | | | | | |
| D7 | P | L | L | | H | H | | L | L | | H | H | | L | L | | | | H | H | | | H | |

(c)

REFRIGERATOR AND METHOD OF CONTROLLING THE SAME

CROSS-REFERENCE TO RELATED APPLICATION

This application claims priority under 35 U.S.C. § 119 to Korean Application No. 10-2018-0074495 filed on Jun. 28, 2018, whose entire disclosure is hereby incorporated by reference.

BACKGROUND

1. Field

A refrigerator and a method of controlling a refrigerator are disclosed herein.

2. Background

A refrigerator may be a home appliance which serves to keep food at a low temperature in an internal compartment shielded by a door. Specifically, the refrigerator may include a refrigerator body having storage compartments formed therein, doors for opening and closing the storage compartments, and a refrigeration cycle device for providing cold air to the storage compartments.

The refrigeration cycle device may be a vapor compression refrigeration cycle device including a compressor for compressing refrigerant, a condenser for condensing refrigerant by radiating heat, an expansion device for decompression-expanding refrigerant, and an evaporator for allowing refrigerant to absorb latent heat therearound and to evaporate. In addition, the refrigerator may include various functions in order to increase user convenience and satisfaction. For example, the refrigerator may include an ice making system for making and dispensing ice cubes. The ice making system may include an ice maker for making ice cubes and an ice bank for storing the ice cubes made by the ice maker.

Related art 1 filed and registered by the present applicant discloses a refrigerator having such an ice making system.

Korean Registration Patent No.: 10-0900287 (Registration Date: May 25, 2009), title of the Invention: Ice maker and method of controlling the same.

The ice maker disclosed in Related art 1 is controlled to make a predetermined amount of ice. At this time, a user may determine the amount of ice stored in the ice banker.

At this time, Related art 1 has the following problems. Since the ice maker makes the predetermined amount of ice, an ice making operation may be continuously performed until the ice bank is full of ice. Accordingly, since ice making operation is continuously performed, noise may be generated and power consumption may be increased. In addition, supercooling and freezing may occur in a refrigerating compartment due to the low temperature of the ice maker and weak cooling may occur in a freezing compartment.

In addition, since the amount of stored ice is determined according to the manual input of a user, the amount of made ice and an ice-making time are manually set. Therefore, it may not be possible to actively control ice making performance.

BRIEF DESCRIPTION OF THE DRAWINGS

Embodiments will be described in detail with reference to the following drawings in which like reference numerals refer to like elements and, wherein:

FIG. 10 illustrates a user pattern and an ice making mode of a refrigerator according to an embodiment.

DETAILED DESCRIPTION

Figure 1:
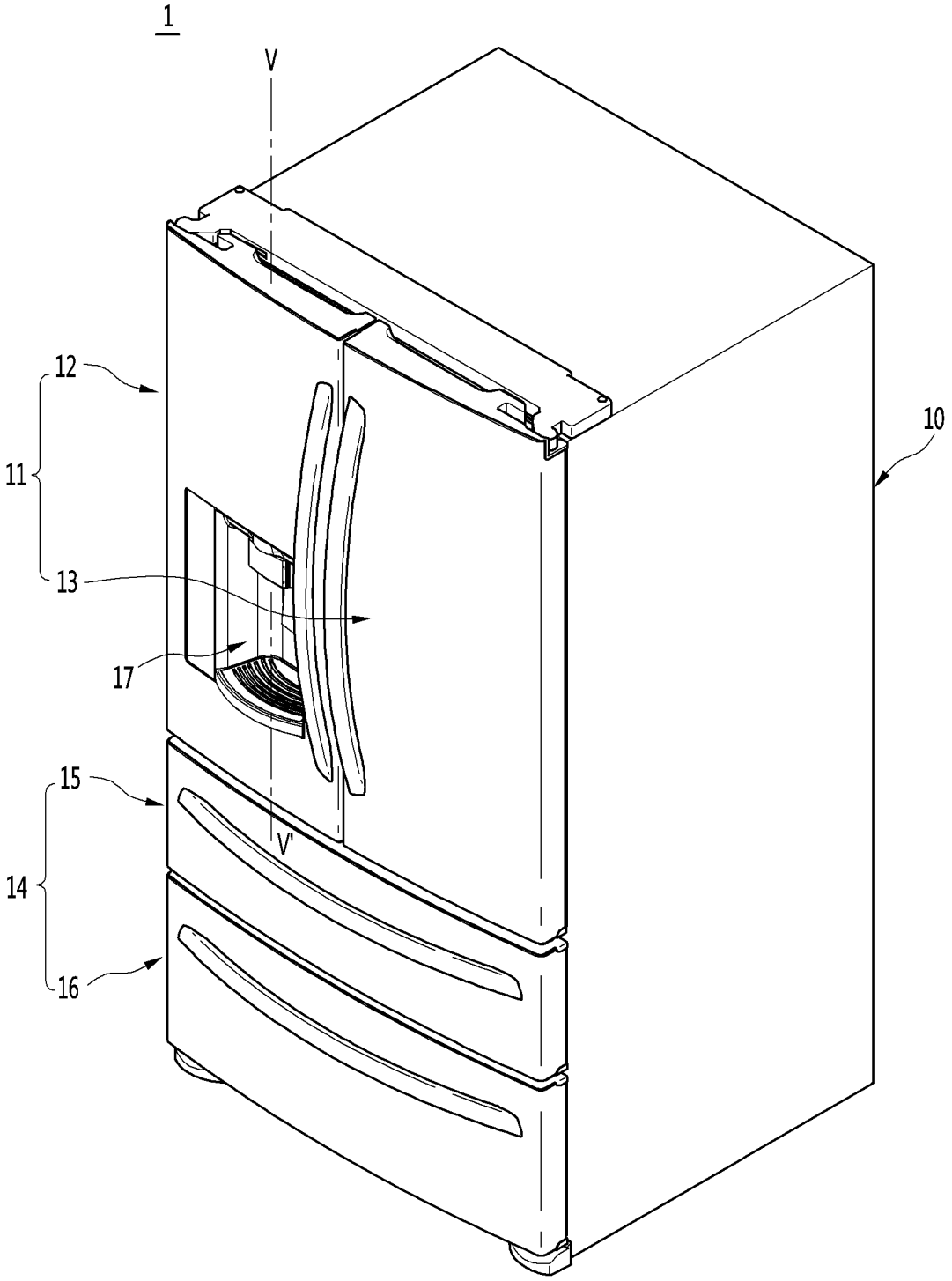
FIG. 1 illustrates a refrigerator according to an embodiment of the present disclosure.
Figure 2:
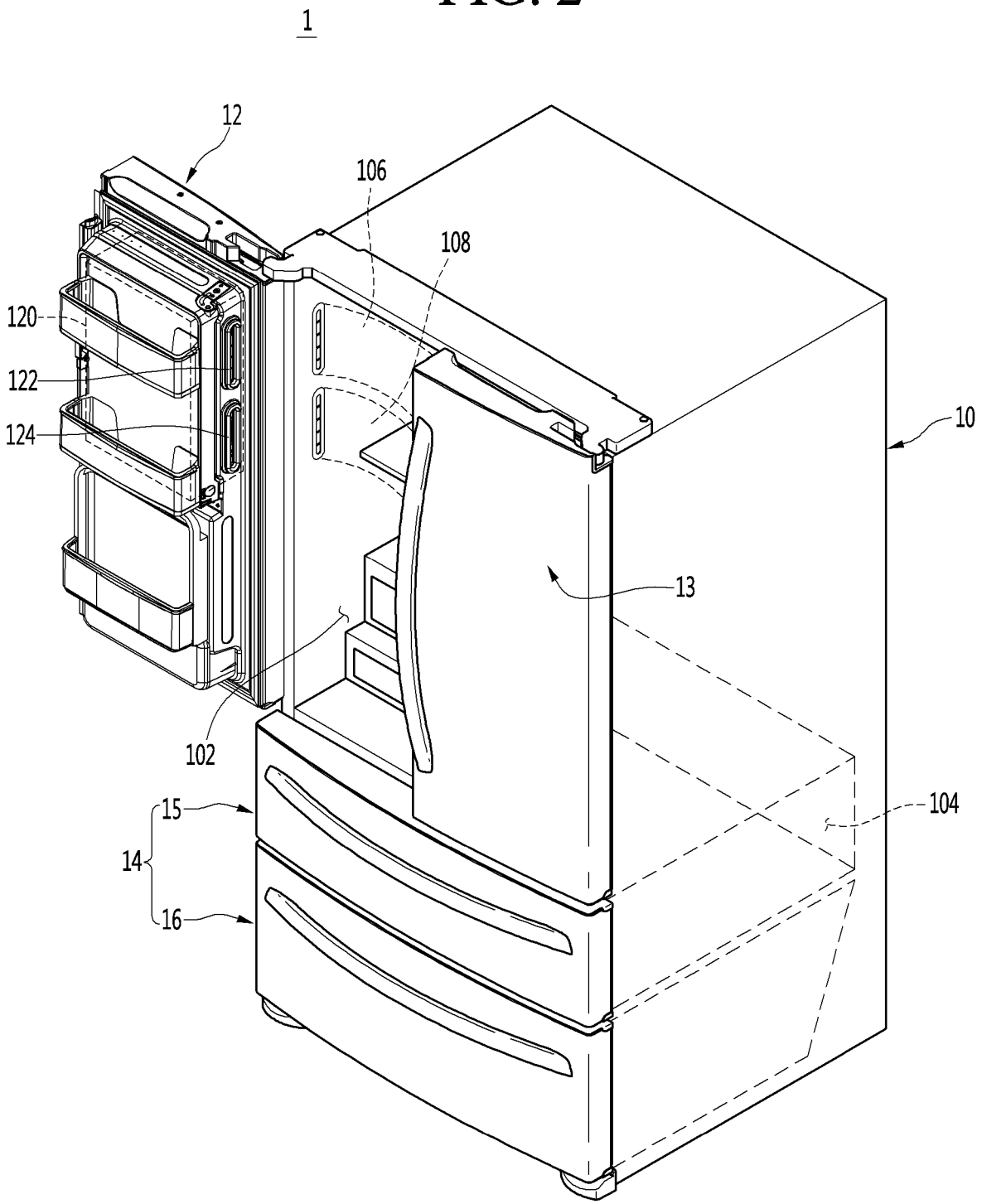
FIG. 2 illustrates a state in which a door of a refrigerator according to an embodiment is opened.

As shown in FIGS. 1 and 2, the refrigerator 1 according to the embodiment of the present disclosure may include a cabinet 10 forming appearance thereof and refrigerator doors 11 and 14 movably connected to the cabinet 10. A storage compartment for keeping food may be formed inside the cabinet 10. The storage compartment may include a refrigerating compartment 102 and a freezing compartment 104 located below the refrigerating compartment 102. The freezing compartment 104 may be maintained at a lower temperature than the refrigerating compartment 102.

The refrigerator according to the embodiment may be a bottom freezer type refrigerator in which a refrigerating compartment is provided above a freezing compartment. However, the refrigerator according to the embodiment may not be limited thereto and may include a top mount type refrigerator in which a freezing compartment is provided above a refrigerating compartment and a side-by-side type refrigerator in which a freezing compartment and a refrigerating compartment are located side by side and partitioned by a partition wall.

The refrigerator doors 11 and 14 may include a refrigerating compartment door 11 for opening and closing the refrigerating compartment 102 and a freezing compartment door 14 for opening and closing the freezing compartment 104. The refrigerating compartment door 11 may include a plurality of doors 12 and 13 located side by side. The plurality of doors 12 and 13 may include a first refrigerating compartment door 12 and a second refrigerating compartment door 13 located at the right or first side of the first refrigerating compartment 12. The first refrigerating compartment door 12 and the second refrigerating compartment door 13 may independently move.

The freezing compartment door 14 may include a plurality of doors 15 and 16 arranged in a vertical direction. The plurality of doors 15 and 16 may include a first freezing compartment door 15 and a second freezing compartment door 16 located below the first freezing compartment door 15.

The first and second refrigerating compartment doors 12 and 13 may be rotatably coupled to the cabinet 10. In addition, the first and second freezing compartment doors 15 and 16 may be slidably coupled to the cabinet 10. This is merely an example and the number and shape of doors coupled to the cabinet 10 may be changed.

The refrigerator 1 according to the embodiment may include a dispenser 17. In particular, the dispenser 17 may be provided in the refrigerator doors 11 and 14. Thus, a user may more conveniently approach the refrigerating compartment doors 12 and 13 in the bottom freezer type refrigerator. In other words, the dispenser 17 may be located in the refrigerating compartment doors 12 and 13 located at the upper side of the refrigerator for user convenience.

The dispenser 17 may be provided in any one of the first and second refrigerating compartment doors 12 and 13. For example, in FIGS. 1 and 2, the dispenser 17 may be provided in the first refrigerating compartment door 12.

The dispenser 17 may allow the user to take out water or ice. In particular, the dispenser 17 may be provided in the front surface of the first refrigerating compartment door 12 to be exposed such that the user takes out water or ice without rotating the first refrigerating compartment door 12.

The refrigerator 1 according to the embodiment may include an ice making compartment 120. The ice making compartment 120 may be formed inside the first refrigerating compartment door 12 in which the dispenser 17 is arranged. However, this is merely an example and the ice making compartment 120 may be provided at various positions.

The ice making compartment 120 may make, store and supply ice to the dispenser 17. Accordingly, the ice making compartment 120 may be provided inside the first refrigerating compartment door 12 to communicate with the dispenser 17.

The ice making compartment 120 may be provided at one side of the refrigerating compartment 102. At this time, the ice making compartment 120 may be maintained at a lower temperature than the refrigerating compartment 102 in order to make and store ice. A cold air supply hole 122, through which cold air is supplied, and a cold air recovery hole 124, through which cold air is recovered, may be formed at one side of the ice making compartment 120.

A main body supply duct 106 for supplying cold air to the ice making compartment 120 and a main body recovery duct 108 for recovering cold air from the ice making compartment 120 may be formed in the cabinet 10. When the first refrigerating compartment door 12 closes the refrigerating compartment 102, the main body supply duct 106, the cold air supply hole 122, the main body recovery duct 108 and the cold air recovery hole 124 may be connected. When the first refrigerating compartment door 12 opens the refrigerating compartment 102, the main body supply duct 106, the cold air supply hole 122, the main body recovery duct 108 and the cold air recovery hole 124 may be separated from each other.

Accordingly, when the first refrigerating compartment door 12 closes the refrigerating compartment 102, cold air may be introduced into the cold air supply hole 122 through the main body supply duct 106 to maintain the ice making compartment 120 at a low temperature. In addition, cold air may be recovered into the cold air recovery hole 124 through the main body recovery duct 108, thereby being circulated.

Ice making compartment gaskets may be provided in edges of the cold air supply hole 120 and the cold air recovery hole 122 such that the main body supply duct 106 and the main body recovery duct 108 are closely connected and sealed. The ice making compartment gaskets may prevent cold air circulated in the ice making compartment 120 from flowing out into the refrigerating compartment 102.

The main body supply duct 106 may communicate with a space where an evaporator is located. Air which has passed through the main body supply duct 106 and the evaporator may be introduced into the ice making compartment 120. The main body recovery duct 108 may communicate with the freezing compartment 104. Accordingly, air discharged from the ice making compartment 120 may flow to the freezing compartment 104 through the main body recovery duct 108.

Figure 3:
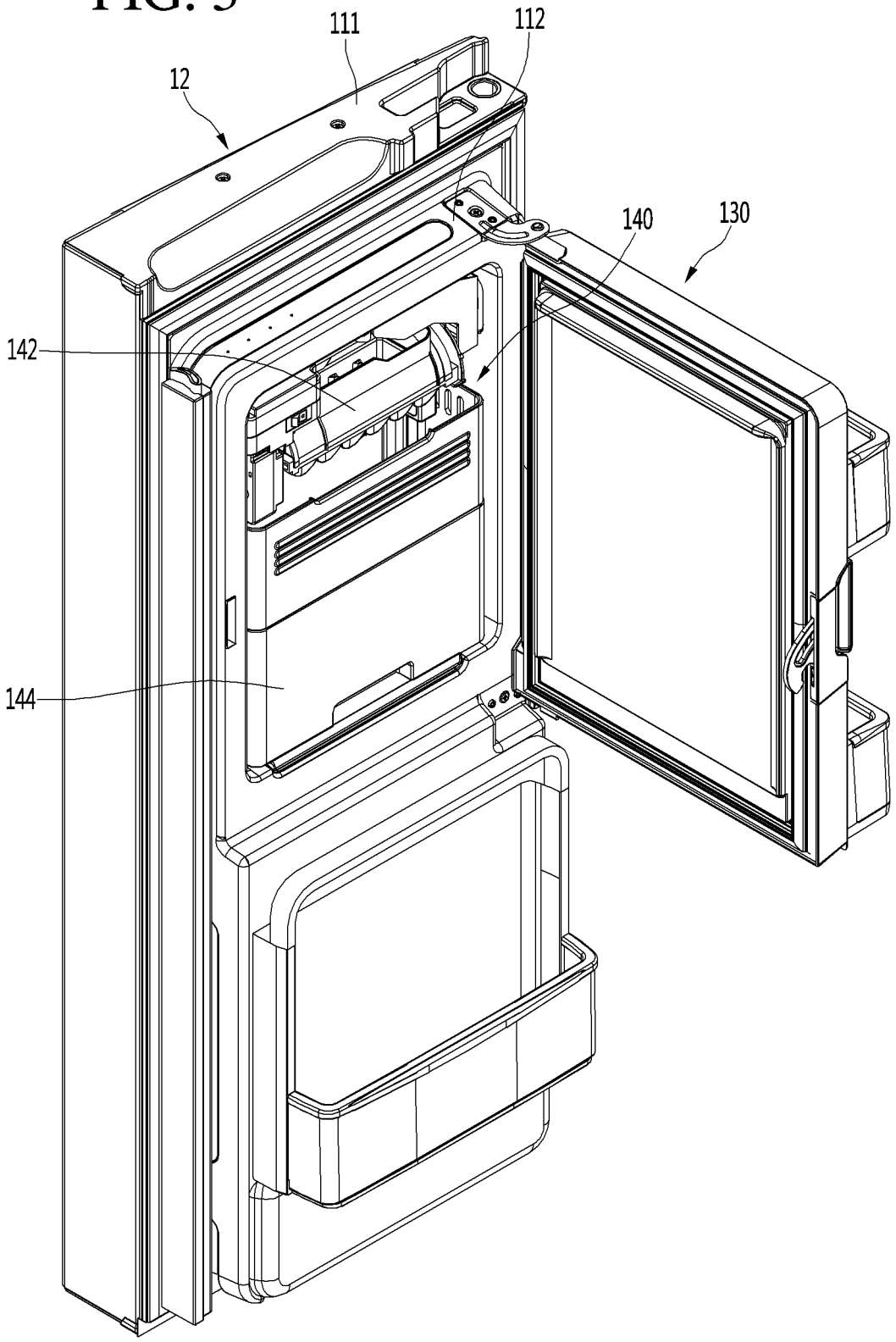
FIG. 3 illustrates a state in which an ice maker door of a refrigerator according to an embodiment is opened.
Figure 4:
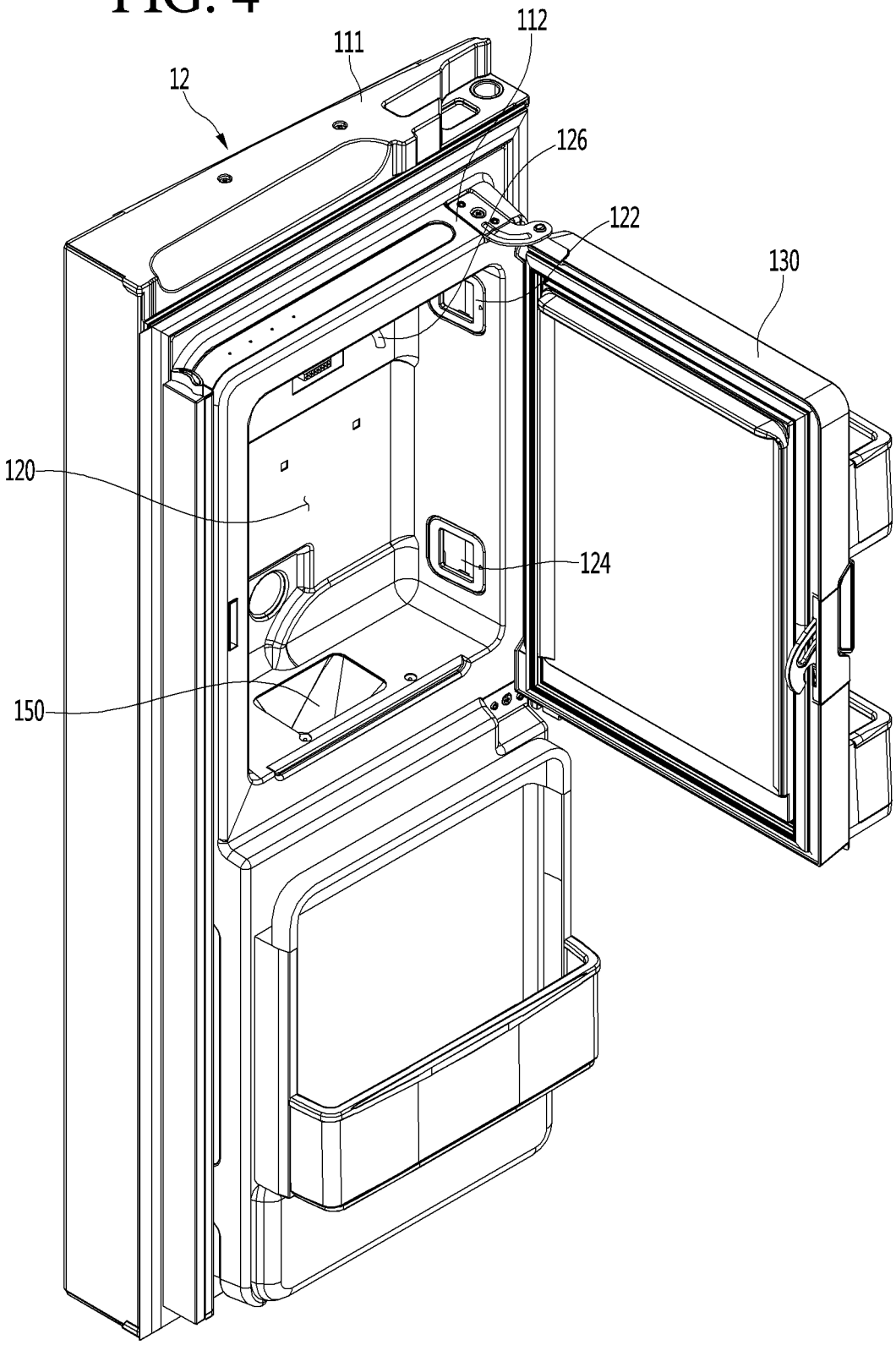
FIG. 4 illustrates a refrigerator according to an embodiment except for an ice making assembly.

Hereinafter, the configuration of the ice making compartment 120 and an ice making process will be described in detail. As shown in FIGS. 3 and 4, the refrigerating compartment door 11 may include an outer case 111 and a door liner 112 coupled to the outer case 111. The door liner 112 may form a rear side of the refrigerating compartment door 11. In addition, the door liner 112 may be a component forming the ice making compartment 120.

The ice making compartment 120 may be opened by an ice making compartment door 130. At this time, the ice making compartment door 130 may be hinged to the door liner 112 to be rotationally connected.

Referring to FIG. 4, the cold air supply hole 122 and the cold air recovery hole 124 may be formed in or at one side of the ice making compartment 120. In addition, a duct structure extending from the cold air supply hole 122 and the cold air recovery hole 124 may be formed in the ice making compartment 120 or a component installed in the ice making compartment 120. Such a structure may cause cold air to flow more efficiently.

An ice making assembly 140 for making and storing ice may be provided inside the ice making compartment 120. The ice making assembly 140 may include an ice maker 142 for generating a predetermined amount of ice and an ice bank 144 for storing ice made by the ice maker 142.

The ice maker 142 may be located above the ice bank 144. In addition, the ice maker 142 may be rotatably installed in the ice making compartment 120. Accordingly, the ice made by the ice maker 142 may drop into the ice bank 144 by rotation of the ice maker 142.

The ice bank 144 may have the form of a box for storing a predetermined amount of ice. The ice bank 144 may have an opened upper portion to receive ice dropped from the ice maker 142. One side of the ice bank 144 may communicate with the dispenser such that the stored ice may be supplied to the dispenser 17.

The ice bank 144 may be detachably provided in the ice making compartment 120. Accordingly, the user may separate the ice bank 144 from the ice making compartment 120 to directly use the ice stored in the ice bank 144.

A water supply part or spout 126 for supplying predetermined water to the ice maker 142 may be provided in the ice making compartment 120. The water supply part 126 may be provided between the outer case 111 and the door liner 112, and may have one end extending to the ice making compartment 120 through the door liner 112 and the other end connected to a water supply source inside or outside the refrigerator 1.

The ice making compartment 120 may include an ice making duct (or ice dispensing duct) 150 communicating with the dispenser 17. When the ice bank 144 is installed in the ice making compartment 120, the ice making duct 150 and the ice bank 144 may communicate with each other. Accordingly, the ice stored in the ice bank 144 may be taken out to the dispenser 17 through the ice making duct 150.

Figure 5:
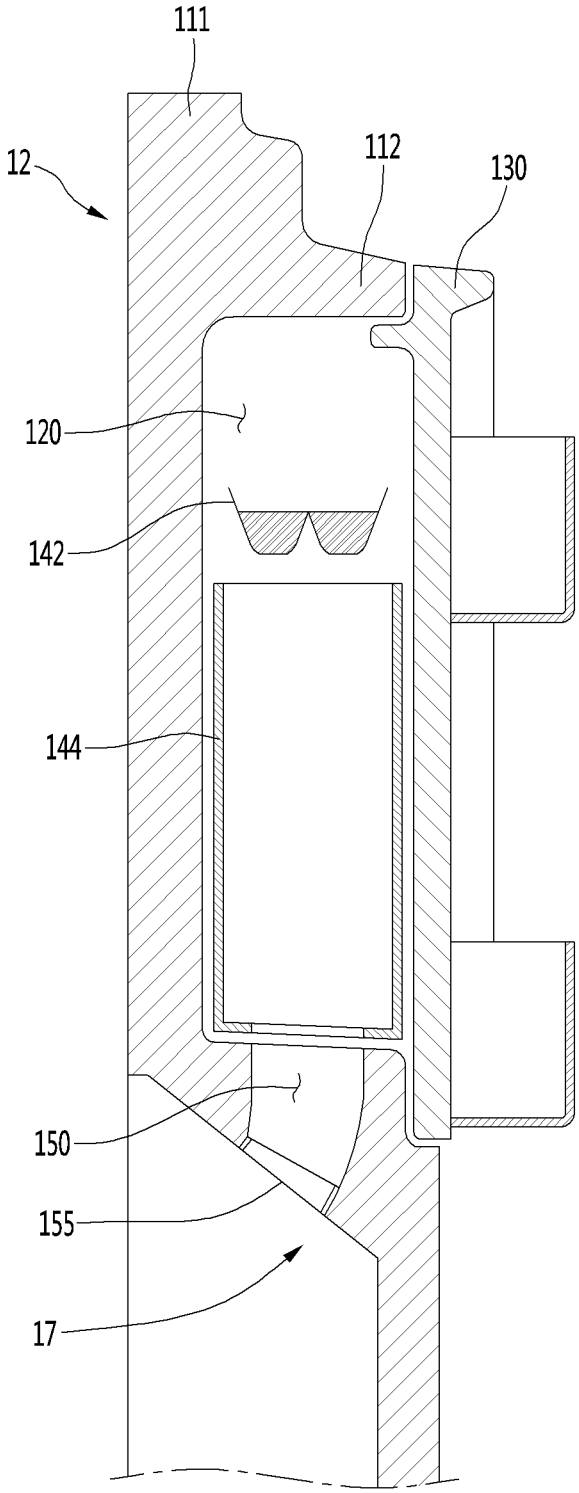
FIG. 5 is a cross-sectional view taken along line V-V' of FIG. 1.
Figure 6:
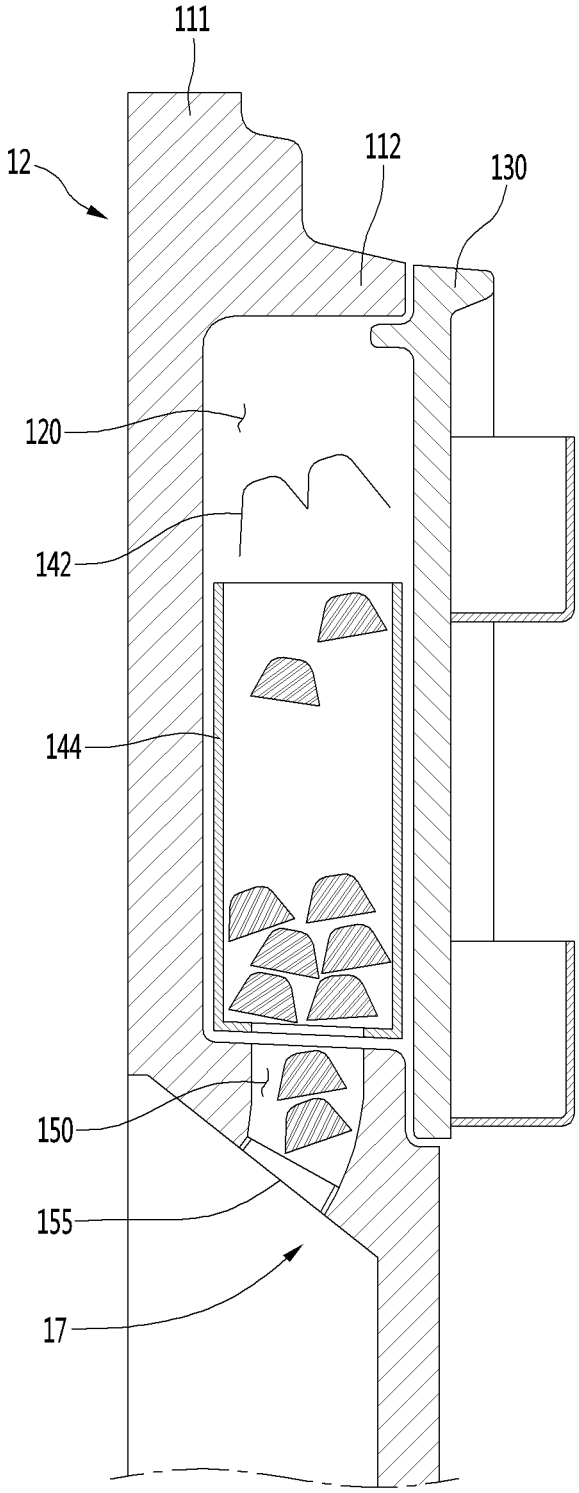
FIG. 6 illustrates a process of forming and storing ice in FIG. 5.
Figure 7:
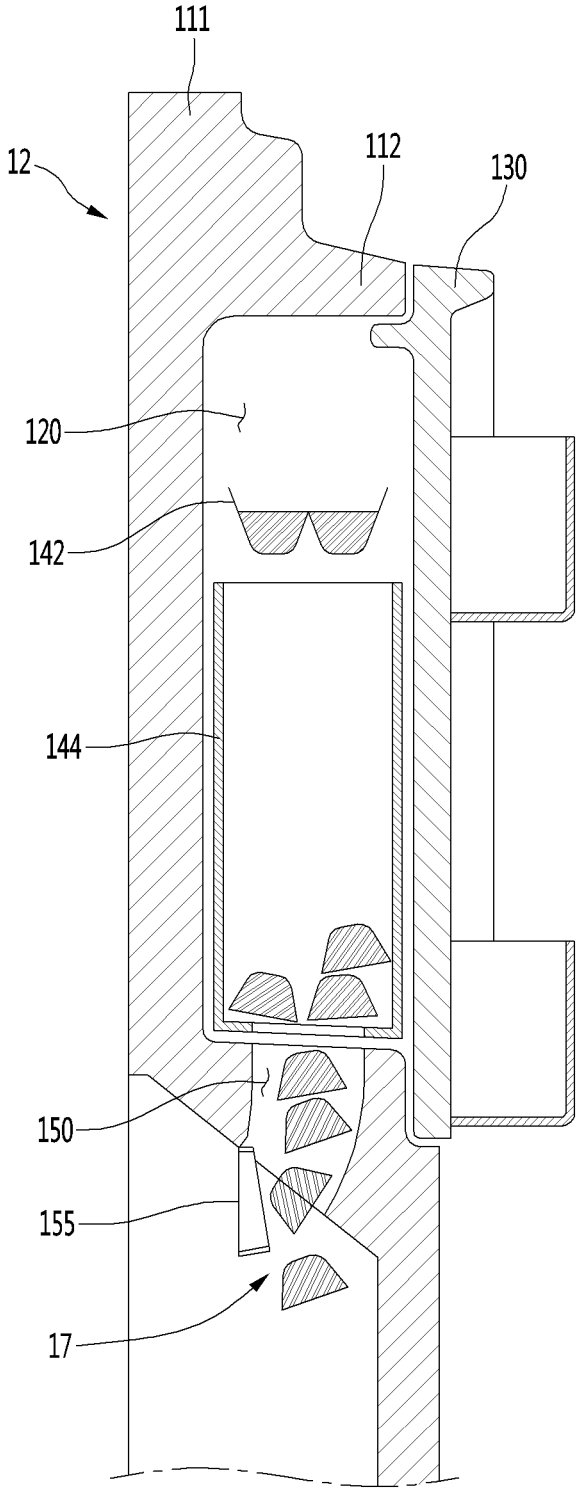
FIG. 7 illustrates a process of taking out ice stored in the process of FIG. 6.

Hereinafter, a process of making, storing and taking out ice to the dispenser 17 using the above-described configuration will be described. For convenience, FIGS. 5 to 7 show a portion of the refrigerator door 12. Specifically, the lower portion of the ice making compartment 120 will be omitted and the configuration of the dispenser 17 is schematically shown.

As shown in FIG. 5, in the ice making compartment 120, the ice maker 142, the ice bank 144, and the ice making duct 150 may be sequentially arranged from top to bottom. Water may be supplied to the ice maker 142, and cold air may be supplied to the ice making compartment 120 to make ice.

The ice making duct 150 may include a duct cap 155 for opening and closing the ice making duct 150. The duct cap 155 may be rotatably provided at one end of the ice making duct 150. When the user takes out ice through the dispenser 17, the duct cap 155 may rotate to one side to open the ice making duct 150.

As shown in FIG. 6, when ice is made by the ice maker 142, the ice maker 142 may rotate. Ice made by the ice maker 142 may be moved to and stored in the ice bank 144. A predetermined amount (hereinafter, a maximum amount) of ice may be stored in the ice bank 144. When the maximum amount of ice is stored in the ice bank 144, a full ice sensor 54 may detect that the ice bank is full of ice, thereby ending the ice making operation.

The user may take out ice from the ice bank 144 directly or through the dispenser 17. When the user directly takes out ice, the ice making compartment door 130 may be opened to separate the ice bank 144 from the ice making compartment 120.

As shown in FIG. 7, ice may be taken out through the dispenser 17. When the user inputs a predetermined mechanical or electrical signal, the duct cap 155 may rotate to open the ice making duct 150. The ice stored in the ice bank 144 may be released to the dispenser 17 along the ice making duct 150.

Figure 8:
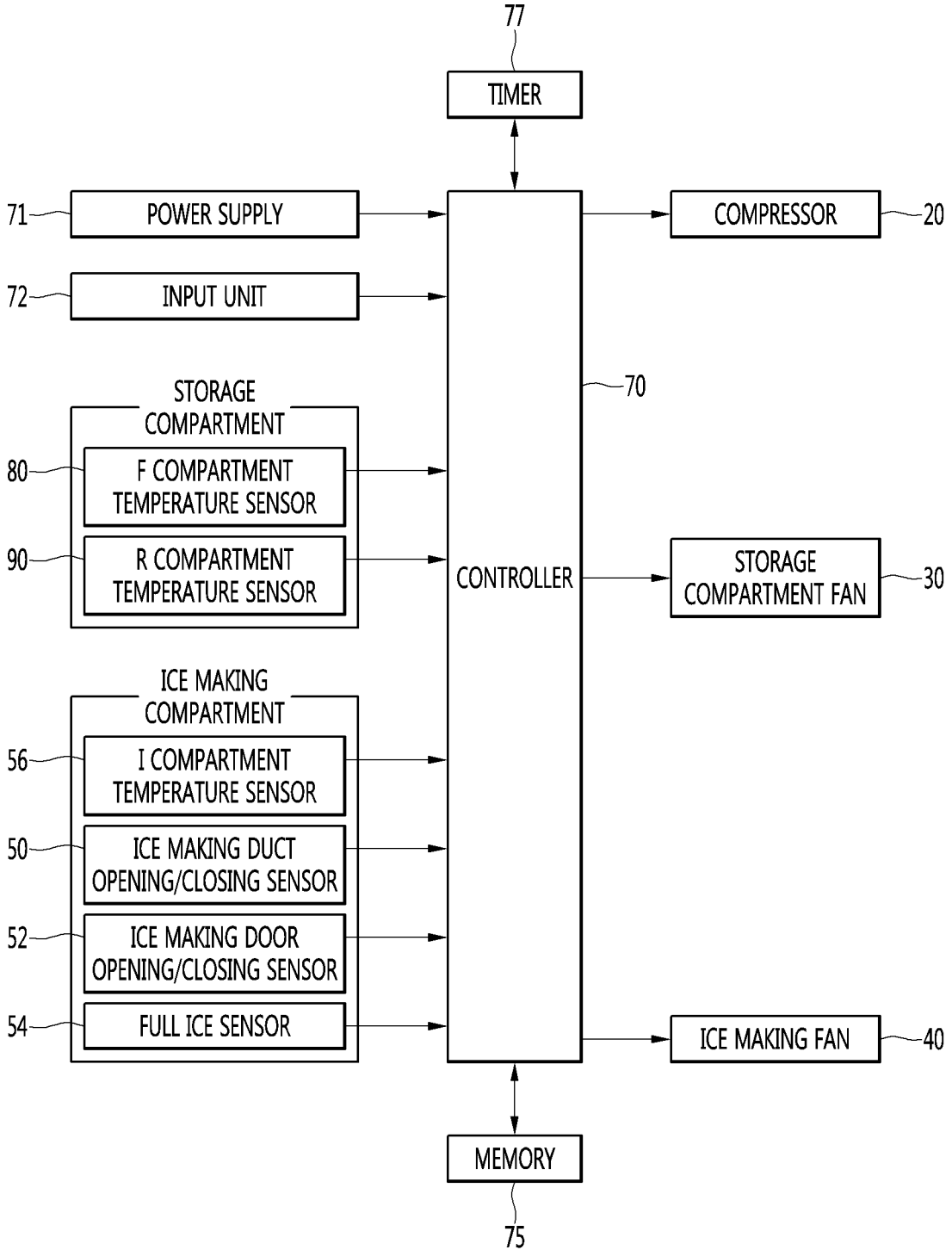
FIG. 8 illustrates the control configuration of a refrigerator according to an embodiment.

As shown in FIG. 8, the refrigerator 1 may include a controller 70 for controlling various components. The controller 70 may control operation of a compressor 20, a storage compartment fan 30 and an ice making fan 40.

The compressor 20 may correspond to a component which forms a cooling cycle along with a condenser and an evaporator. At this time, the compressor 20 may be provided in a machine compartment located at a rear lower portion of the refrigerator 1.

The controller 70 may control ON/OFF of the compressor 20 to drive and stop a freezing cycle. The controller 70 may also control the operating frequency and operating time of the compressor 20.

The storage compartment fan 30 may correspond to a component for enabling air passing through the evaporator to flow to the refrigerating compartment 102 or the freezing compartment 104. The ice making fan 40 may correspond to a component for enabling air passing through the evaporator to flow to the ice making compartment 120.

The storage compartment fan 30 and the ice making fan 40 may be provided in a cooling compartment along with the evaporator. The cooling compartment may be formed behind the freezing compartment 104. In particular, the refrigerator 1 may have one evaporator provided behind the freezing compartment 104.

The ice making fan 40 may enable air of the cooling compartment to flow to the ice making compartment 120. In particular, by operation of the ice making fan 40, cold air of the cooling compartment may be supplied to the ice making compartment 120 along the main body supply duct 106. The main body supply duct 106 may extend to the inside of the cooling compartment by penetrating through the cabinet 10.

The controller 70 may control ON/OFF of the storage compartment fan 30 and the ice making fan 40 such that cold air flows to the storage compartments 102 and 104 and the ice making compartment 120. In addition, the controller 70 may control the temperatures of the storage compartments 102 and 104 and the ice making compartment 120.

The controller 70 may control the speed of the storage compartment fan 30 and the ice making fan 40 in a plurality of steps. The controller may increase or decrease the RPM of the motor for applying driving force to the storage compartment fan 30 and the ice making fan 40.

The refrigerator 1 may include a power supply 71, an input unit (or input) 72 and a sensor. For example, the power supply 71 may be provided in the refrigerator 1 as a cord for inputting external power. Accordingly, the refrigerator 1 may be turned on/off by the power supply 71.

The input unit 72 may have various functions. For example, the input unit 72 may include a button for inputting a desired refrigerator temperature (hereinafter referred to as a set temperature). The user may control the temperatures of the freezing compartment 104 and the refrigerating compartment 102 through the input unit 72 as necessary.

The user may control the temperature of the ice making compartment 120, the amount of ice stored in the ice bank 144, and the ice making assembly 140 through the input unit 72. For example, the user may input an ice making prohibition time such that the ice making assembly 140 does not operate at the ice making prohibition time. In addition, the user may select an ice making mode through the input unit 72.

The input unit 72 may be provided as a mechanical input device, a touch type input device, and an external device to input predetermined signals to the controller 70. The input unit 72 may have various shapes and a plurality of input units may be provided.

The various types of sensors may include an F compartment temperature sensor 80 and an R temperature sensor 90 for respectively measuring the temperatures of the freezing compartment 104 and the refrigerating compartment 102. The F compartment temperature sensor 80 and the R compartment temperature sensor 90 may be respectively installed in the freezing compartment 104 and the refrigerating compartment 102. The sensor may include an I compartment temperature sensor 56 for measuring the temperature of the ice making compartment 120. The I or ice compartment temperature sensor 56 may be installed in the ice making compartment 120.

Hereinafter, the temperature values measured by the F compartment temperature sensor 80, the R compartment temperature sensor 90, and the I compartment temperature sensor 56 will be referred to as an F compartment temperature, an R compartment temperature, and an I compartment temperature. Since the F compartment temperature sensor 80, the R compartment temperature sensor 90, and the I compartment temperature sensor 56 continuously measure the temperature values at an interval of a unit time, the F compartment temperature, the R compartment temperature, and the I compartment temperature may correspond to values which continuously vary with time.

The sensor may include an ice making duct opening/closing sensor 50 for detecting whether the ice making duct 150 is opened or closed. For example, the ice making duct opening/closing sensor 50 may detect whether one rotating side of the duct cap 155 is in contact with the ice making duct 150. Therefore, whether the user takes out ice through the dispenser 17 may be detected.

The sensor may include an ice making door opening/closing sensor 52 for detecting whether the ice making compartment door 130 is opened or closed or whether the ice bank 144 is separated. For example, whether the one rotating side of the ice making compartment door 130 and the door liner 112 are brought into contact with each other may be detected. In addition, whether the ice bank 144 and the ice making compartment 120 are brought into contact with each other may be detected.

Therefore, whether the user takes out ice through the dispenser 17 may be detected. Whether the user checks the ice stored in the ice bank 144 may also be detected. The sensor may also include a full ice sensor for detecting whether the ice bank 144 is full of ice, or whether a maximum amount of ice is stored in the ice bank 144. The sensor may also include a defrost temperature sensor for measuring the temperature of the evaporator, a temperature sensor for measuring another temperature or various sensors for measuring humidity, smell, cleanliness, etc.

The refrigerator 1 may include a memory 75 for storing predetermined information. The controller 70 may control the compressor 20 through information input through the power supply 71, the input unit 72, and the various sensors and information stored in the memory 75.

The refrigerator 1 may include a timer 77. The timer 77 may store a predetermined time according to a signal of the controller 70. In addition, the timer 77 may transmit a predetermined time interval to the controller 70. For example, the timer 77 may measure a time when the ice making duct 150 is opened by the ice making duct opening/closing sensor 50.

Hereinafter, control of ON/OFF of the compressor 20 will be briefly described based on the above-described control configuration. External power may be input through the power supply 71 and the set temperature may be input through the input unit 72. The set temperature may be input by the user or may be a value stored in the memory 75. The set temperatures of the freezing compartment 104 and the refrigerating compartment 102 may be set to different values.

The F compartment temperature and the R compartment temperature may be measured by the F compartment temperature sensor 80 and the R compartment temperature sensor 90, respectively. Fundamentally, when the F compartment temperature or the R compartment temperature is higher than each set temperature, the compressor 20 is turned on.

Specifically, upper-limit and lower-limit ranges may be stored in the memory 75. For example, the upper-limit and lower-limit ranges may be set to 0.3 degrees. This is merely an example, and the upper-limit and lower-limit ranges may be differently stored and may have various values.

The upper-limit and lower-limit set temperatures of the set temperature may be determined. For example, when the set temperature is 4 degrees and the upper-limit and lower-limit ranges are 0.3 degrees, the upper-limit set temperature is set to 4.3 degrees and the lower-limit set temperature is set to 3.7 degrees.

The controller 70 may turn on the compressor 20 when the F compartment temperature or the R compartment temperature is higher than the upper-limit set temperature. When the F compartment temperature or the R compartment temperature is lower than the lower-limit set temperature, the compressor 20 may be turned off. In this process, the controller 70 may turn the compressor 20 on/off.

The storage compartment fan 30 and the ice making fan 40 may be turned on/off when the compressor 20 is turned on/off. Specifically, when the compressor 20 is turned on, the storage compartment fan 30 and the ice making fan 40 may be turned on, and, when the compressor 20 is turned off, the storage compartment fan 30 and the ice making fan 40 may be turned off.

Hereinafter, ice making control will be described based on the above-described control configuration. The ice making control may include making, storing and taking-out of ice.

Figure 9:
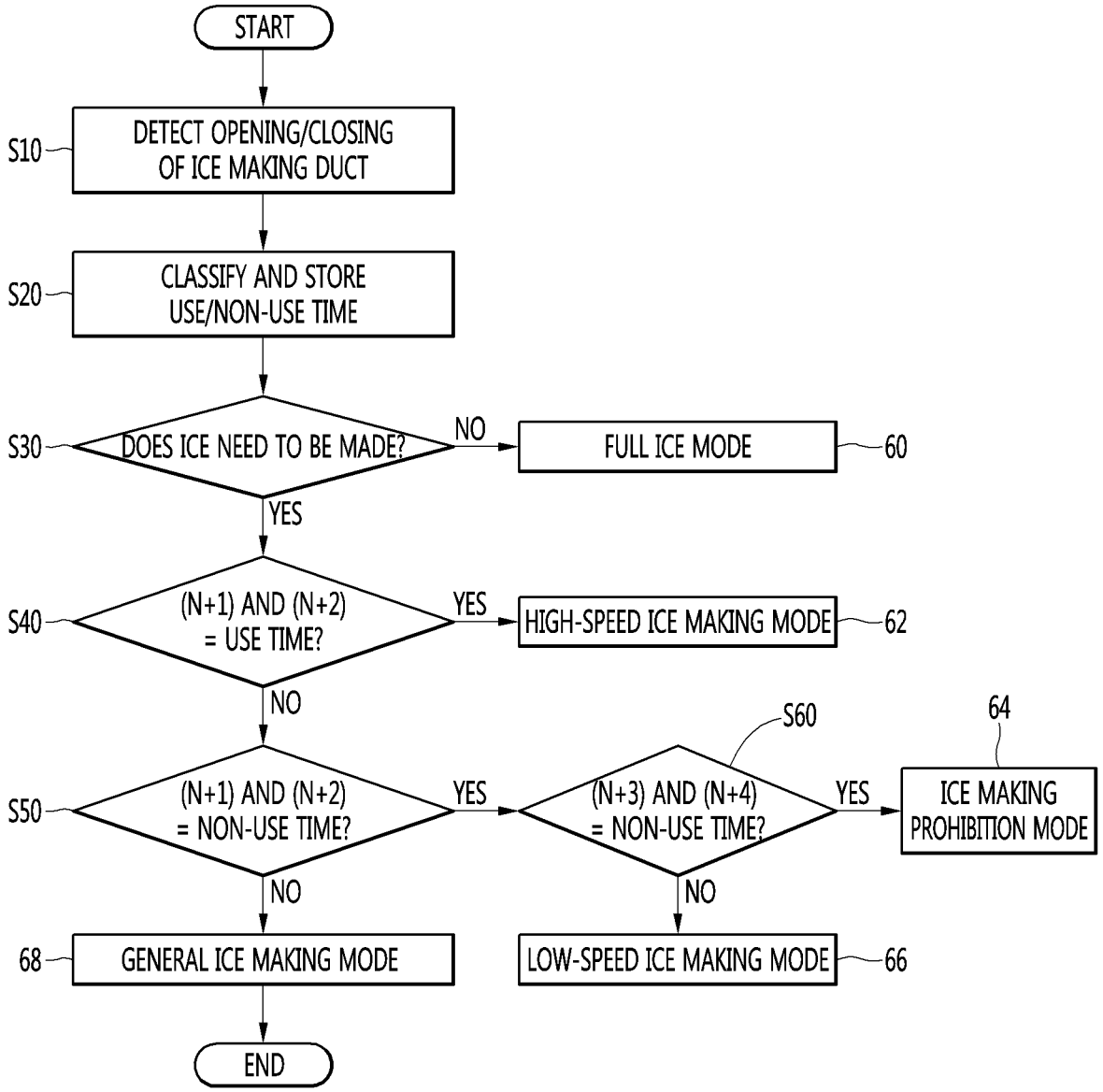
FIG. 9 is a flowchart illustrating a method of controlling a refrigerator according to an embodiment.

As shown in FIGS. 9 and 10, for ice making control, step S10 of detecting opening/closing of the ice making duct 150 and step S20 of classifying and storing a use/non-use time may be performed. Opening/closing detection and classification may be performed based on the unit time. Hereinafter, for convenience of description, the unit time is 1 hour. This is an example and the unit time may be variously set. In addition, the time may mean a unit and may be denoted by unit (or U) corresponding to a unit to be distinguished from a general time.

As the unit time is set to 1 hour, a day may be divided into 24 steps. This may be divided into times of 0 to 23 in FIG. 10. Specifically, unit time 0 means 0:00 to 1:00 and unit time 1 means 1:00 to 2:00.

At this time, each unit time may be classified according to the unit time of the above-described sensors. For example, when the sensors detect information in 1 second, unit time 0 may mean\ 0:00:00 to 0:59:59 and unit time 1 may mean 1:00:00 to 1:59:59.

In addition, opening/closing of the ice making duct 150 detected for the unit time, that is, 1 hour, may be stored. Opening of the ice making duct 150 may be measured by a rotation time of the duct cap 155 detected by the ice making duct opening/closing sensor 50. A time when the duct cap 155 is separated from the ice making duct 150 may be stored as opening of the ice making duct 150.

Referring to FIG. 10(*a*), the ice making duct 150 is opened for 10 seconds in unit time 0 and is opened for 0 seconds in unit time 1 on Recorded Day 1(R1), for example. In addition, the ice making duct 150 is opened for 0 seconds in unit time 0 and unit time 1, that is, the ice making duct 150 is not opened, on Recorded Day 2(R2). for example. As another example, the controller may determine a length of time or amount of times a user presses or activates the input unit.

Through such data, a unit time when ice is taken out through the dispenser 17 may be identified. Accordingly, the ice use pattern of the user may be checked. When the opening time is long, a determination may be made that the user frequently uses ice and, when the ice making duct is not opened or when the opening time is short, a determination may be made that the user does not use ice or infrequently uses ice.

The number of times of opening the duct cap 155 may be further considered. Opening of 10 seconds may be divided into a case where the duct cap 155 is opened once or a case where the duct cap 155 is opened twice. The amount of ice which is taken out in each case may also be measured through experimentation and stored in the memory 75.

Whether the ice making compartment 120 is opened/closed or whether the ice bank 144 is separated may be further considered. In other words, the case where the user directly takes out ice from the ice bank 144 may be considered.

Whether the ice making compartment 120 is opened or closed may be detected depending on whether the ice making compartment door 130 is separated. Whether the ice bank 144 is separated may be detected depending on whether the ice bank 144 and the ice making compartment 120 are separated from each other.

For example, the opening time of the ice making compartment 120 and the opening time of the ice making duct 150 may be summed and stored. The opening time of the ice making duct 150 and the opening time of the ice making compartment 120 may be summed and each unit time may be classified into a use time and a non-use time and stored.

The ice use pattern of the user may be measured using various methods. In FIG. 10, for convenience of description, only the opening time of the duct cap 155 is shown.

Such information may be continuously measured according to operation of the refrigerator 1. As shown in FIG. 10(*a*), an average of the information measured on Recorded Day 1(R1) and the information measured on Recorded Day 2(R2) may be recorded. Therefore, as the operating day increases, the stored value may be continuously changed and the ice use pattern of the user may be more clearly checked.

The unit time may be classified into the use time and the non-use time. The use time may be a unit time when the user relatively frequently uses ice and the non-use time may be a unit time when the user does not or relatively infrequently uses ice. Referring to FIG. 10(*b*), it can be seen that each unit time is classified into the use time (UT) and the non-use time (Not shown at FIG. 10(*b*)).

At this time, each unit time may be classified as the use/non-use time depending on whether the opening time of the ice making duct 150 exceeds a reference time. For example, when the reference time is set to 5 seconds, and the ice making duct 150 is opened for 5 seconds or more at any unit time, the unit time may be classified as the use time (UT). Accordingly, when the opening time of the ice making duct 150 is 10 seconds in unit time 0, unit time 0 may be classified as the use time (UT). When the opening time of the ice making duct 150 is 3 seconds in unit time 1, unit time 1 may be classified as the non-use time.

The opening time may a total opening time in each unit time and may correspond to an average value on each day. Therefore, the opening time may be changed according to the number of operating days and classification of the use/non-use time may be changed.

Ice making control may be performed according to the stored use/non-use time. In ice making control, the refrigerator 1 may operate in a plurality of modes. The mode may be roughly divided into an ice making mode in which ice needs to be made and a full ice mode 60 in which ice does not need to be made.

Whether ice needs to be made (S30) may be determined according to the amount of ice detected by the full ice detector 54. Upon detecting that the maximum amount of ice is stored in the ice bank 144, it may be determined that ice does not need to be made. At this time, the maximum amount of ice may correspond to the value stored in the memory 75 or a value set by the user.

In the full ice mode 60, the ice making fan 40 may operate in order to maintain the already generated ice. The ice making assembly 140 may not operate in this case. Specifically, the ice making fan 40 may operate to maintain the temperature of the ice making compartment 120 in a predetermined range. This may be general control and thus a detailed description thereof will be omitted.

When the amount of ice stored in the ice bank 144 is less than the maximum amount of ice, it may be determined that ice needs to be made. The refrigerator 1 may be controlled in a plurality of ice making modes.

The plurality of ice making modes may include a general ice making mode 68, a high-speed ice making mode 62, a low-speed ice making mode 66, and an ice making prohibition mode 64.

The general ice making mode 68 may be a general or standard ice making mode. Specifically, the ice making fan 40 may operate at a reference speed, and the ice making compartment 120 may be maintained in a reference temperature range. The temperatures of the freezing compartment 104 and the refrigerating compartment 102 may be maintained in set temperature ranges.

The high-speed ice making mode 62 may be an ice making mode performed when ice needs to be more rapidly made than the general ice making mode 68. Specifically, the ice making fan 40 may operate at a first speed higher than the reference speed. In other words, the RPM of the motor for transmitting power to the ice making fan 40 may increase, and the ice making fan 40 may rotate at a high speed.

The ice making compartment 120 may also be maintained in a first temperature range lower than the reference temperature range. In particular, the first temperature range may correspond to a temperature range in which ice is more rapidly made than the reference temperature range. Therefore, the ice making fan 40 may operate for a longer time.

By such control, supercooling of the refrigerating compartment 102 and undercooling of the freezing compartment 104 may occur. Specifically, since the ice making compartment 120 may be located at one side of the refrigerating compartment 102, decrease in temperature of the ice making compartment 120 may cause decrease in temperature of the refrigerating compartment 102. Therefore, the temperature of the refrigerating compartment 102 may be equal to or less than the set temperature range.

As a relatively large amount of cold air flows into the ice making compartment 120 according to operation of the ice making fan 40, cold air may not be sufficiently supplied to the freezing compartment 104. Therefore, the temperature of the freezing compartment 104 may be equal to or greater than the set temperature range.

In order to prevent this, control may be performed such that the temperature of the refrigerating compartment 102 is set higher than the set temperature range and the temperature of the freezing compartment 104 is set lower than the set temperature range. For example, when the set temperature range of the refrigerating compartment 102 is 3.7 degrees to 4.3 degrees, the temperature of the refrigerating compartment 102 may be temporarily set to 4 degrees to 4.6 degrees.

The low-speed ice making mode 66 may be an ice making mode performed when ice is more slowly made than the general ice making mode 68. The low-speed ice making mode 66 may correspond to an ice making mode in which power consumption is reduced as compared to the general ice making mode 68.

The ice making fan 40 may operate at a second speed lower than the reference speed. In other words, the RPM of the motor for transmitting power to the ice making fan 40 may decrease and the ice making fan 40 may rotate at a low speed.

The ice making compartment 120 may be maintained in a second temperature range higher than the reference temperature range. Therefore, the ice making fan 40 may operate for a shorter time. Since a smaller amount cold air flows from the cooling compartment to the ice making compartment 120, freezing efficiency of the freezing compartment 104 may increase.

Accordingly, the ice making fan 40 may operate at a relatively low speed for a shorter time, and, as the freezing efficiency of the freezing compartment 104 increases, the compressor 20 may operate at a relatively low operating frequency for a shorter time. Therefore, power consumed in the ice making fan 40 and the compressor 20 may decrease.

The ice making prohibition mode 64 may be a mode in which ice is not made even though the ice bank 144 is not a full ice state. The ice making prohibition mode 64 may be performed when it is predicted that ice is not used for a relatively long time. In particular, in the ice making prohibition mode 64, the ice making assembly 140 may not operate and ice drop according to rotation of the ice maker 142 may not occur.

The user may select and perform any one of the plurality of ice making modes through the input unit 72 as necessary. In particular, the user may perform an input such that the ice making prohibition mode 64 is performed at a bedtime. Therefore, it may be possible to prevent noise from occurring due to ice drop.

The plurality of ice making modes may be automatically selected and performed under a predetermined condition. Such ice making modes may be determined through the stored use/non-use time. In particular, the ice making mode may be determined through the use/non-use time at a unit time after a current time. This may take into account a time required to make ice.

The current time may mean a currently classified unit time. For example, in the case of 3:34:50, the current unit time may be a unit time 3. In addition, the unit times after the current time may correspond to the unit times after the current unit time. For example, when the current unit time is a unit time 3, the unit times after the current time may correspond to unit time 4, unit time 5, unit time 6 and the like.

The unit times after the current unit time may mean a unit time relatively close to the current unit time. For example, the unit times after the current unit time may be determined as being within four unit times of the current unit time.

For convenience of description, in FIG. 9, a unit time after one unit time from the current unit time may be described as N+1. For example, when the current unit time is unit time 3, N+1 corresponds to unit time 4. In addition, N+2 may be understood as unit time 5, N+3 may be understood as unit time 6, and N+4 may be understood as unit time 7.

When the plurality of ice making modes is classified, the high-speed ice making mode 62 may be performed when the unit times after the current unit time correspond to continuous use times. The low-speed ice making mode 66 may be performed when the unit times after the current unit time correspond to continuous non-use times. The ice making prohibition mode 64 may be performed when the unit times after the current unit time correspond to continuous non-use times with a frequency than that of the low-speed ice making mode 66.

When the unit times after the current unit time do not correspond to the continuous non-use or use times, the general ice making mode 66 may be performed. In other words, when both the use time and the non-use time appear in the unit times after the current unit time, the general ice making mode 66 may be performed.

Referring to FIG. 9, when (N+1) and (N+2) correspond to the use times (S40), the high-speed ice making mode 62 may be performed. In addition, (N+1) and (N+2) correspond to the non-use times (S50), the low-speed ice making mode 66 may be performed. At this time, (N+3) and (N+4) may also correspond to the non-use times (S60), the ice making prohibition mode 64 may also be performed. Otherwise, the general ice making mode 68 may be performed. In summary, any one of (N+1) and (N+2) may be the use time and the other thereof may be the non-use time, the general ice making mode 68 may be performed.

According such a criterion, as shown in FIG. 10(*c*), the mode performed at each unit time is described. For convenience of description, the general ice making mode 68 is not described, the low-speed ice making mode 66 is described as L, the ice making prohibition mode 64 is described as P, and the high-speed ice making mode 62 is described as H.

For example, on Day 1, the low-speed ice making mode 66 may be performed at unit time 3, because unit time 4 and 5 are classified as the non-use time. In addition, since unit time 6 is classified as the use time, the ice making prohibition mode 64 may not be performed.

Since classification of the use/non-use time of each unit time is changed according to the operation time, the operation mode of each unit time may also be changed. Therefore, on Day 7, the general ice making mode 68 may be performed at unit time 3, because unit time 4 may be classified as the non-use time and unit time 5 may be classified as the use time.

The criterion for selecting the ice making mode may be differently set as necessary. In addition, the criterion may be set by the user and may be set to a value stored in the memory 75. For example, the high-speed ice making mode 62 may be performed when (N+2) and (N+3) are the use times. Therefore, it may be possible to ensure a larger amount of ice.

The ice making prohibition mode 64 may not be used by the use/non-use time but may be determined by user selection. Therefore, it may be possible to reduce a time when ice is not made even if ice needs to be made.

Various ice making modes may be performed using the ice use pattern of the user. Accordingly, it may be possible to increase user satisfaction and to reduce power consumption. In addition, various ice making modes may be manually selected by the user or automatically selected according to predetermined conditions, thereby maximizing user convenience.

A refrigerator and the method of controlling a refrigerator according to the embodiments of the present disclosure having the above configuration may have the following effects. As any one of a plurality of ice making modes is performed according to the ice use pattern of a user, it may be possible to maximize ice making performance and to provide user convenience.

In particular, a high-speed ice making mode among the plurality of ice making modes may be performed in preparation for continuous use times, thereby supplying a sufficient amount of ice to the user. A low-speed ice making mode among the plurality of ice making modes may be performed in preparation for continuous non-use times, thereby reducing power consumption.

An ice making prohibition mode among the plurality of ice making modes may be performed in preparation for continuous non-use times or according to user input, thereby preventing noise and providing user convenience.

In a method of controlling a refrigerator according to an aspect of the present disclosure, an ice making mode which varies according to a use time and a non-use time may be performed. Specifically, opening/closing of an ice making duct, through which ice is taken out may be detected, and an opening time of the ice making duct per unit time may be stored. Each unit time may be classified as a use time when the opening time of the ice making duct is equal to or greater than a reference time and each unit time is classified as a non-use time when the opening time of the ice making duct is less than the reference time.

In addition, whether ice needs to be made may be determined and any one of a plurality of ice making modes may be performed according to classification of the use time and the non-use time when ice needs to be made. A general ice making mode in which an ice making fan for allowing air passing through an evaporator to flow into an ice making compartment operates at a reference speed may be included.

A high-speed ice making mode in which the ice making fan operates at a first speed higher than the reference speed may be included. A low-speed ice making mode in which the ice making fan operates at a second speed lower than the reference speed may be included. An ice making prohibition mode in which it is determined that ice needs to be made and ice is not made may be included.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a refrigerator including a controller and an ice making fan, the method comprising:

detecting an opening/closing of an ice dispensing duct, through which ice is dispensed from an ice maker in the refrigerator;

storing a total length of time which the ice dispensing duct is open over a plurality of predetermined time intervals;

classifying each of the plurality of time intervals as a use time when the length of time which the ice dispensing duct is open is equal to or greater than a reference time, and classifying each of the plurality of time intervals as a non-use time when the length of time which the ice dispensing duct is open is less than the reference time;

determining whether ice needs to be made according to an amount of ice detected by a full ice sensor; and performing any one of a plurality of ice making modes according to classification of the use time and the non-use time when ice needs to be made, wherein each ice making mode comprises operating the ice making fan at a different fan speed, and wherein the plurality of ice making modes includes:

a general ice making mode in which the ice making fan configured to circulate air that passes through an evaporator into an ice making compartment operates at a reference speed, a high-speed ice making mode in which the ice making fan operates at a first speed higher than the reference speed, and a low-speed ice making mode in which the ice making fan operates at a second speed lower than the reference speed.

2. The method of claim 1, wherein any one of the plurality of ice making modes is performed at a specific time interval after a previous time interval is classified as one of the use time or the non-use time.

3. The method of claim 1, wherein the high-speed ice making mode is performed when a first time interval (N+1) and a second time interval (N+2) are determined to be use times, and wherein the low-speed ice making mode is performed when the first time interval (N+1) and the second time interval (N+2) are determined to be non-use times.

4. The method of claim 1, wherein the ice making compartment is maintained within a reference temperature range in the general ice making mode, wherein the ice making compartment is maintained within a first temperature range that extends lower than the reference temperature range in the high-speed ice making mode, and wherein the ice making compartment is maintained within a second temperature range that extends higher than the reference temperature range in the low-speed ice making mode.

5. The method of claim 4, wherein in the high-speed ice making mode, a temperature range of a refrigerating compartment is controlled to extend higher than a predetermined temperature range of the refrigerating compartment, and a temperature range of a freezing compartment is controlled to extend lower than a predetermined temperature range of the freezing compartment.

6. The method of claim 1, wherein the plurality of ice making modes further includes an ice making prohibition mode in which ice is not made after determining that ice needs to be made.

7. The method of claim 6, wherein the ice making prohibition mode is performed during at least one time interval, and ice is not made during the time interval when the ice making prohibition mode is performed.

8. The method of claim 1, wherein:

an opening/closing of an ice making compartment door configured to open/close the ice making compartment in which the ice dispensing duct is formed is detected, a sum of a length of time which the ice dispensing duct is open and a length of time which the ice making compartment door is open is stored over one of the predetermined time intervals, and the predetermined time interval is classified as the use time when the sum of the length of time of the ice dispensing duct being open and the length of time of the ice making compartment door being open is equal to or greater than another reference time, and is classified as the non-use time when the sum of the length of time of the ice dispensing duct being open and the length of time of the ice making compartment door being open is less than the other reference time.

9. A refrigerator comprising:

a cabinet including a refrigerating compartment and a freezing compartment located adjacent to the refrigerating compartment;

a refrigerating compartment door coupled to the cabinet to open and close the refrigerating compartment and including a dispenser through which water or ice is dispensed;

an ice making compartment formed inside the refrigerating compartment door;

an ice maker located inside the ice making compartment to make and store ice;

an ice dispensing duct communicating with the ice making compartment and the dispenser to guide the ice stored in the ice making assembly to the dispenser;

an ice making fan configured to circulate air;

an ice dispensing duct opening/closing sensor configured to detect whether the ice dispensing duct is opened;

a memory configured to store a length of time which the ice dispensing duct is open detected by the ice dispensing duct opening/closing sensor for a plurality of predetermined time intervals; and a controller configured to classify each predetermined time interval as any one of a use time or a non-use time through the length of time which the ice dispensing duct is open stored in the memory for each predetermined time interval; and to perform any one of a plurality of ice making modes, wherein the ice making fan operates at a speed which varies according to a specified ice making mode among the plurality of ice making modes, and wherein the plurality of ice making modes include:

a general ice making mode in which the ice making fan configured to circulate air that passes through an evaporator into an ice making compartment operates at a reference speed, a high-speed ice making mode in which the ice making fan operates at a first speed higher than the reference speed, and a low-speed ice making mode in which the ice making fan operates at a second speed lower than the reference speed.

10. The refrigerator according to claim 9, further comprising:

a cooling compartment located behind the freezing compartment and including an evaporator;

a main body supply duct that extends from the cooling compartment to the ice making compartment along the cabinet in order to supply cold air to the ice making compartment; and a main body recovery duct that extends from the ice making compartment to the freezing compartment along the cabinet in order to recover air from the ice making compartment.

11. The refrigerator according to claim 9, wherein the refrigerating compartment is maintained within a first predetermined temperature range during the general ice making mode, and the refrigerating compartment is maintained within a second predetermined temperature range that extends higher than the first predetermined temperature range during the high-speed ice making mode.

12. The refrigerator according to claim 9, wherein the ice making fan is configured to circulate air that has passed through an evaporator to flow into the ice making compartment.

13. The refrigerator according to claim 12, further comprising an ice-compartment temperature sensor configured to detect a temperature of the ice making compartment, wherein the ice making compartment is maintained in a temperature range which varies according to the specified ice making mode among the plurality of ice making modes.

14. The refrigerator according to claim 12, further comprising:

an ice making compartment door coupled to the refrigerating compartment door and configured to open and close the ice making compartment; and an ice making compartment door opening/closing sensor configured to detect whether the ice making compartment is opened by the ice making compartment door, wherein the memory stores a sum of a length of time which the ice dispensing duct is open detected by the ice dispensing duct opening/closing sensor and a length of time which the ice making compartment is open detected by the ice making compartment door opening/closing sensor for each time interval, and wherein the controller is configured to:

classify each time interval as any one of the use time or the non-use time depending on the length of time which the ice dispensing duct is open and the length of time which the ice making compartment is open stored in the memory for each time interval, and perform any one of the plurality of ice making modes.

15. A method of controlling a refrigerator including a controller and an ice making fan, the method comprising:

detecting an opening/closing of an ice dispensing duct, through which ice is dispensed from an ice maker in the refrigerator;

storing a total length of time which the ice dispensing duct is open over a plurality of predetermined time intervals;

classifying each of the plurality of time intervals as a use time when the length of time which the ice dispensing duct is open is equal to or greater than a reference time, and classifying each of the plurality of time intervals as a non-use time when the length of time which the ice dispensing duct is open is less than the reference time;

determining whether ice needs to be made based on a sensed amount of ice; and performing any one of a plurality of ice making modes according to classification of the use time and the non-use time when ice needs to be made, wherein each ice making mode comprises operating the ice making fan at a different fan speed, and wherein:

an opening/closing of an ice making compartment door configured to open/close the ice making compartment in which the ice dispensing duct is formed is detected, a sum of a length of time which the ice dispensing duct is open and a length of time which the ice making compartment door is open is stored over one of the predetermined time intervals, and the predetermined time interval is classified as the use time when the sum of the length of time of the ice dispensing duct being open and the length of time of the ice making compartment door being open is equal to or greater than another reference time, and is classified as the non-use time when the sum of the length of time of the ice dispensing duct being open and the length of time of the ice making compartment door being open is less than the other reference time.

* * * * *